US009721503B2

(12) United States Patent
Kato et al.

(10) Patent No.: US 9,721,503 B2
(45) Date of Patent: Aug. 1, 2017

(54) DISPLAY DEVICE TO CORRECT A VIDEO SIGNAL WITH INVERSE EL AND DRIVE TFT CHARACTERISTICS

(71) Applicant: Japan Display Inc., Minato-ku (JP)

(72) Inventors: Hirofumi Kato, Tokyo (JP); Takayuki Nakanishi, Tokyo (JP); Tatsuya Yata, Tokyo (JP)

(73) Assignee: Japan Display Inc., Minato-ku (JP)

( * ) Notice: Subject to any disclaimer, the term of this patent is extended or adjusted under 35 U.S.C. 154(b) by 109 days.

(21) Appl. No.: 14/753,733

(22) Filed: Jun. 29, 2015

(65) Prior Publication Data

US 2015/0379931 A1 Dec. 31, 2015

(30) Foreign Application Priority Data

Jun. 30, 2014 (JP) ..... 2014-134308

(51) Int. Cl.
*G09G 3/3233* (2016.01)

(52) U.S. Cl.
CPC ... *G09G 3/3233* (2013.01); *G09G 2300/0842* (2013.01); *G09G 2320/029* (2013.01); *G09G 2320/0233* (2013.01); *G09G 2320/0276* (2013.01); *G09G 2320/043* (2013.01); *G09G 2320/045* (2013.01); *G09G 2320/0673* (2013.01)

(58) Field of Classification Search
CPC .... G09G 3/3233; G09G 3/3241; G09G 3/325; G09G 3/3291; G09G 3/3258; G09G 2320/0233; G09G 2320/0204; G09G 2320/0242; G09G 2320/0271; G09G 2320/0276; G09G 2320/0266; G09G 2320/043; G09G 2320/045; G09G 2320/0693; G09G 2320/029; G09G 2330/12; G09G 2300/0413
See application file for complete search history.

(56) References Cited

U.S. PATENT DOCUMENTS

2006/0098024 A1* 5/2006 Kohno ..... G09G 3/3208 345/589
2007/0153021 A1* 7/2007 Umeda ..... G09G 3/2007 345/600

(Continued)

FOREIGN PATENT DOCUMENTS

WO WO 2008/136358 A1 11/2008

*Primary Examiner* — Nalini Mummalaneni
*Assistant Examiner* — Darlene M Ritchie
(74) *Attorney, Agent, or Firm* — Oblon, McClelland, Maier & Neustadt, L.L.P.

(57) ABSTRACT

According to one embodiment, a display device includes a plurality of pixels arranged in a matrix on a substrate, each including a luminescent element and a drive transistor configured to supply current to the luminescent element for light emission, and a panel characteristics correction unit configured to correct for display a video signal supplied from outside, to be supplied to a respective one of the pixels, and the panel characteristics correction unit includes an EL characteristics correction unit configured to correct the video signal with inverse luminescent characteristics of the luminescent element, and a TFT characteristics correction unit configured to correct the video signal with inverse drive characteristics of the drive transistor.

12 Claims, 11 Drawing Sheets

(56) References Cited

U.S. PATENT DOCUMENTS

| | | | | |
|---|---|---|---|---|
| 2008/0055618 | A1* | 3/2008 | Simmons | G09G 5/06 358/1.9 |
| 2008/0100554 | A1* | 5/2008 | Mori | G09G 3/3406 345/89 |
| 2008/0266332 | A1* | 10/2008 | Inoue | G09G 3/3208 345/690 |
| 2009/0189924 | A1* | 7/2009 | Ogura | G09G 3/3233 345/690 |
| 2010/0156766 | A1* | 6/2010 | Levey | G09G 3/3233 345/78 |
| 2015/0002378 | A1* | 1/2015 | Nathan | G09G 3/3241 345/77 |
| 2015/0029171 | A1* | 1/2015 | Jo | G09G 3/3258 345/212 |
| 2016/0027382 | A1* | 1/2016 | Chaji | G09G 3/006 345/212 |
| 2016/0086548 | A1* | 3/2016 | Maeyama | G09G 3/3258 345/690 |

* cited by examiner

DISPLAY DEVICE TO CORRECT A VIDEO SIGNAL WITH INVERSE EL AND DRIVE TFT CHARACTERISTICS

CROSS-REFERENCE TO RELATED APPLICATIONS

This application is based upon and claims the benefit of priority from Japanese Patent Application No. 2014-134308, filed Jun. 30, 2014, the entire contents of which are incorporated herein by reference.

FIELD

Embodiments described herein relate generally to a display device.

BACKGROUND

In recent years, there is a quickly increasing demand of flat-panel display devices represented by the liquid crystal display devices because of its advantageous features of thinness, lightness and low energy consumption. Especially, the active-matrix display device, in which ON pixels and OFF pixels are electrically separated and pixel switches having the function to make a video signal retained in ON pixels are provided in the pixels, is used for various displays including the portable information device.

As such a flat-panel type active-matrix display device, an organic electroluminescent (EL) display device which employs a luminescent element, has attracted attention, and research and development thereof are carried out intensively. Since the organic electroluminescent display device does not require a backlight but has a high-speed responsibility, it is suitable for moving image reproduction. Further, the luminance is not lowered at low temperature, and therefore it has the feature of being suitable also for use in a cold atmosphere.

Generally, the organic electroluminescent display device comprises pixels arranged in rows and columns. Each pixel comprises an organic electroluminescent element, which is a luminescent element, and a pixel circuit configured to supply a drive current to the organic electroluminescent element. Display operation is performed by controlling the luminance of the organic electroluminescent element.

Moreover, in an organic electroluminescent display device, various kinds of corrections are carried out on video signals in order to reproduce high-quality images. Here, for example, a technique of detecting the drive state of an organic electroluminescent display device to carry out various kinds of corrections has been disclosed.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a display device includes a plurality of pixels arranged in a matrix on a substrate, each comprising a luminescent element and a drive transistor configured to supply current to the luminescent element for light emission; and a panel characteristics correction unit configured to correct for display a video signal supplied from outside, to be supplied to a respective one of the pixels, wherein the panel characteristics correction unit comprises an EL characteristics correction unit configured to correct the video signal with inverse luminescent characteristics of the luminescent element, and a TFT characteristics correction unit configured to correct the video signal with inverse drive characteristics of the drive transistor.

Embodiments will now be described with reference to accompanying drawings.

Note that the disclosure is presented for the sake of exemplification, and any modification and variation conceived within the scope and spirit of the embodiments by a person having ordinary skill in the art are naturally encompassed in the scope of embodiment of the present application. Furthermore, a width, thickness, shape, and the like of each element are depicted schematically in the figures as compared to actual embodiments for the sake of simpler explanation, and they do not limit the interpretation of the present embodiments. Furthermore, in the description and Figures of the present application, structural elements having the same or similar functions will be referred to by the same reference numbers and detailed explanations of them that are considered redundant may be omitted.

Figure 1:
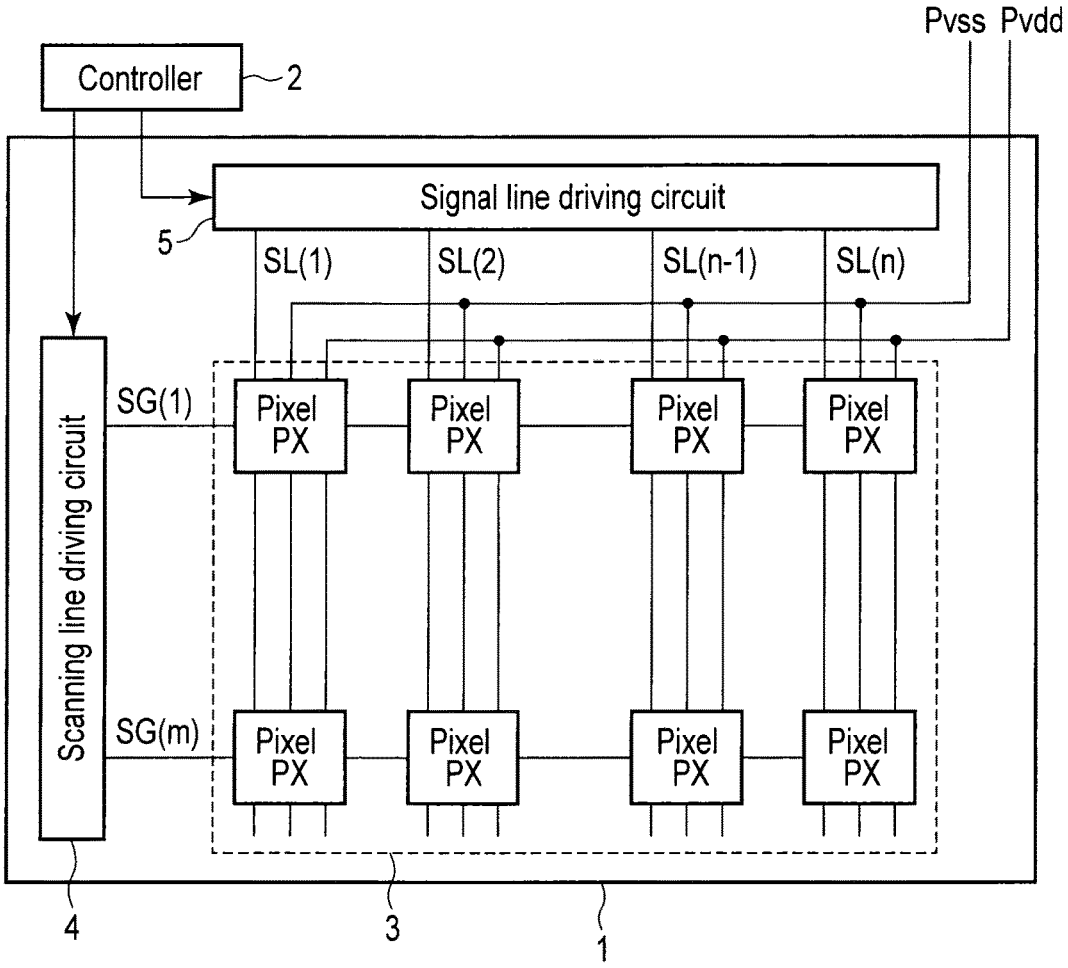
FIG. 1 is an exemplary plan view briefly showing a display device according to an embodiment.

FIG. 1 is an exemplary plan view showing briefly a display device according to an embodiment. As shown in FIG. 1, the display device comprises an organic EL panel 1 and a controller 2 configured to control the organic EL panel 1.

The organic EL panel 1 comprises a display area 3, a scanning line driving circuit 4 and a signal line driving circuit 5.

The display area 3 comprises (m times n)-number of display pixels PX arranged in matrix on an insulating substrate having light-transmissivity, such as a glass board. Further, gate lines SG(1 to m) are provided along rows in which display pixel PX are disposed, and each line connects those display pixels PX disposed on each respective row. Further, n signal lines SL(1 to n) are provided along columns in which display pixels PX are disposed, and each line connects those display pixels PX disposed on each respective column. Furthermore, a high-potential power supply line Pvdd and a low-potential power line Pvss are connected to each display pixel PX.

The scanning line driving circuit 4 is configured to drive each of the gate lines SG(1 to m) sequentially by each row of display pixels PX. The signal line driving circuit 5 is configured to drive two or more signal lines SL(1 to n). The scanning line driving circuit 4 and the signal line driving circuit 5 are formed on the insulating substrate but outside the display area 3 integrally as one unit, thus forming a control unit together with the controller 2.

Figure 2:
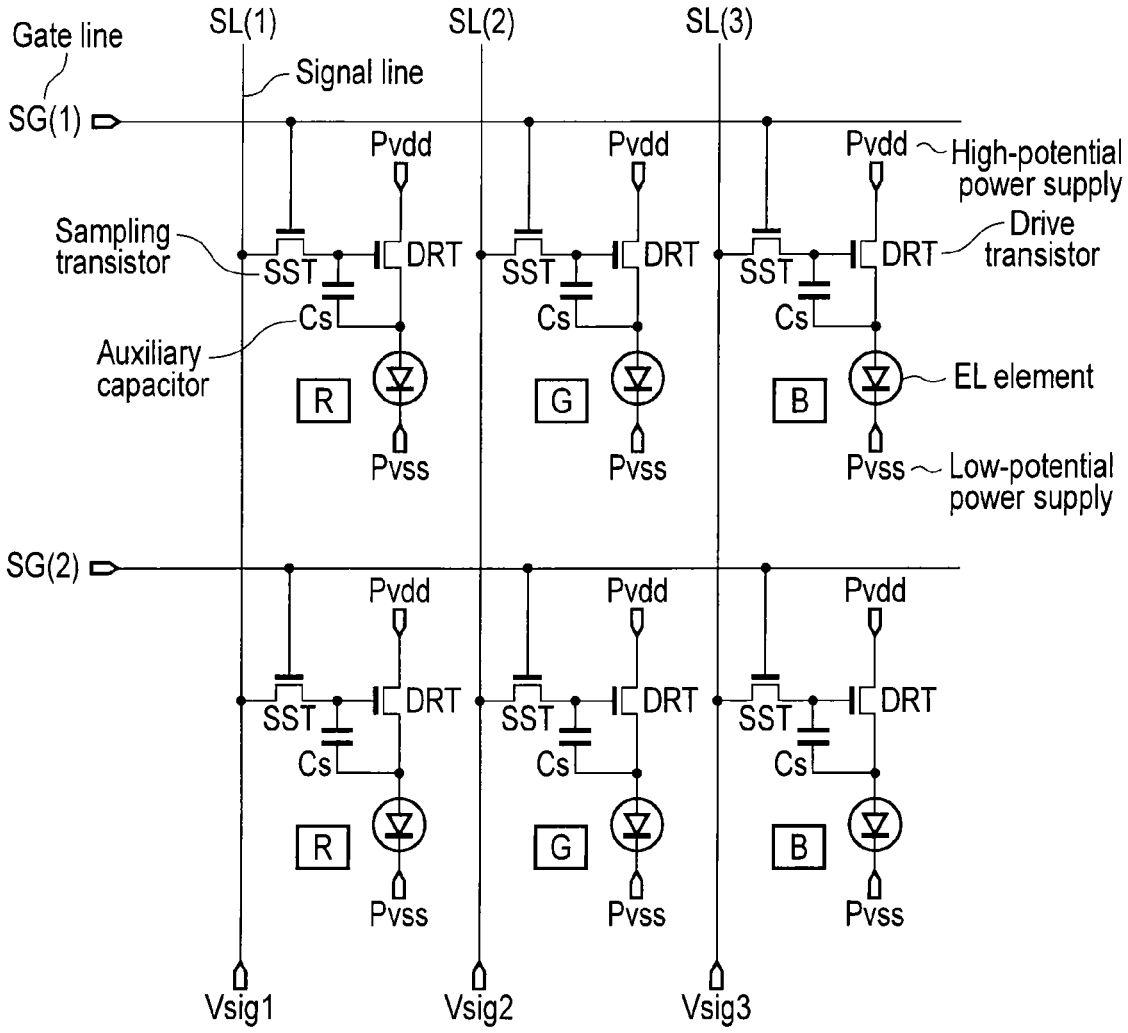
FIG. 2 is an exemplary view briefly showing pixel circuits and EL elements of the display device according to the embodiment.

FIG. 2 is an exemplary view briefly showing pixel circuits and EL elements of the display device according to the embodiment. The areas of the display pixels PX surrounded by the gate lines SG and signal lines SL contain EL (electroluminescent) elements configured to emit light of RGB colors, respectively, and a pixel circuit configured to drive each respective EL element. Note that the illustration of the pixel circuits shown in FIG. 2 is simplified to describe their basic operation.

Each pixel circuit comprises a sampling transistor SST, a drive transistor DRT and an auxiliary capacitor Cs. A first terminal of the drive transistor DRT is electrically connected to a high-potential power supply line Pvdd (high potential power supply). A second terminal of the drive transistor DRT is electrically connected to a control terminal (the third terminal) of the drive transistor DRT through the auxiliary capacitor Cs. Further, the second terminal of the drive transistor DRT is electrically connected to an anode electrode of the EL element. A cathode electrode of the EL element is electrically connected to a low-potential power line Pvss (low-potential power).

The first terminal of the sampling transistor SST is electrically connected to a signal line SL. The second terminal of the sampling transistor SST is electrically connected to the control terminal (the third terminal) of the drive transistor DRT. The control terminal of sampling transistor SST is electrically connected to a gate line SG. Here, the gate line SG is driven by the scanning line driving circuit 4 disposed on a left side of the organic EL panel 1 as viewed in FIG. 1. The signal line SL is driven by the signal line driving circuit 5 disposed in an upper portion of the organic EL panel 1 as viewed in FIG. 1.

In the display device according to this embodiment, the drive transistor DRT and sampling transistor SST are thin-film transistors (TFT) of the same conductivity type, for example, N-channel type. Further, all the thin-film transistors that form the drive transistor DRT and sampling transistor SST, are respectively formed by the same process to have the same layer structure, which is, for example, thin-film transistors of the top gate structure which employs IGZO, a-Si, or polysilicon, in its semiconductor layer. Note that the sampling transistor SST and the drive transistor DRT are not limited to the N-channel type, but may be of a P-channel type. When using a P-channel type drive transistor DRT, the auxiliary capacitor Cs is electrically connected between the high potential power supply line Pvdd (high potential power supply) and the control terminal (the third terminal).

The controller 2 provided in an end portion of the organic EL panel 1 acquires a video signal, a synchronizing signal, various types of command signals, etc., from an external signal source (not shown) by communications. Upon receiving these signals, the controller 2 controls the signal line driving circuit 5 and generates the control signal to the scanning line driving circuit 4. The signal line driving circuit 5 D/A-converts a digital video signal to an analog signal and supplies an analog pixel signal Vsig to the signal line SL.

When an n-th gate line SG(n) is set at a high level "H", the sampling transistor SST connected to the signal line SL, the drive transistor DRT and the auxiliary capacitor Cs is made conductive, and thus the pixel signal Vsig output from the signal line driving circuit 5 is written in the auxiliary capacitor Cs. Accordingly, the drive transistor DRT is made conductive so that the current flows between power supplies Pvdd and Pvss, and thus the EL element emits light. The degree of the current flowing at this time corresponds to the potential of the auxiliary capacitor Cs, that is, the pixel signal Vsig. The luminance of the EL element is higher as the current flowing to the EL element is higher. The EL current is controlled by the pixel signal Vsig. Therefore, the EL current increases as the voltage of the pixel signal Vsig becomes higher, for the EL element to emit light brighter.

Figure 3:
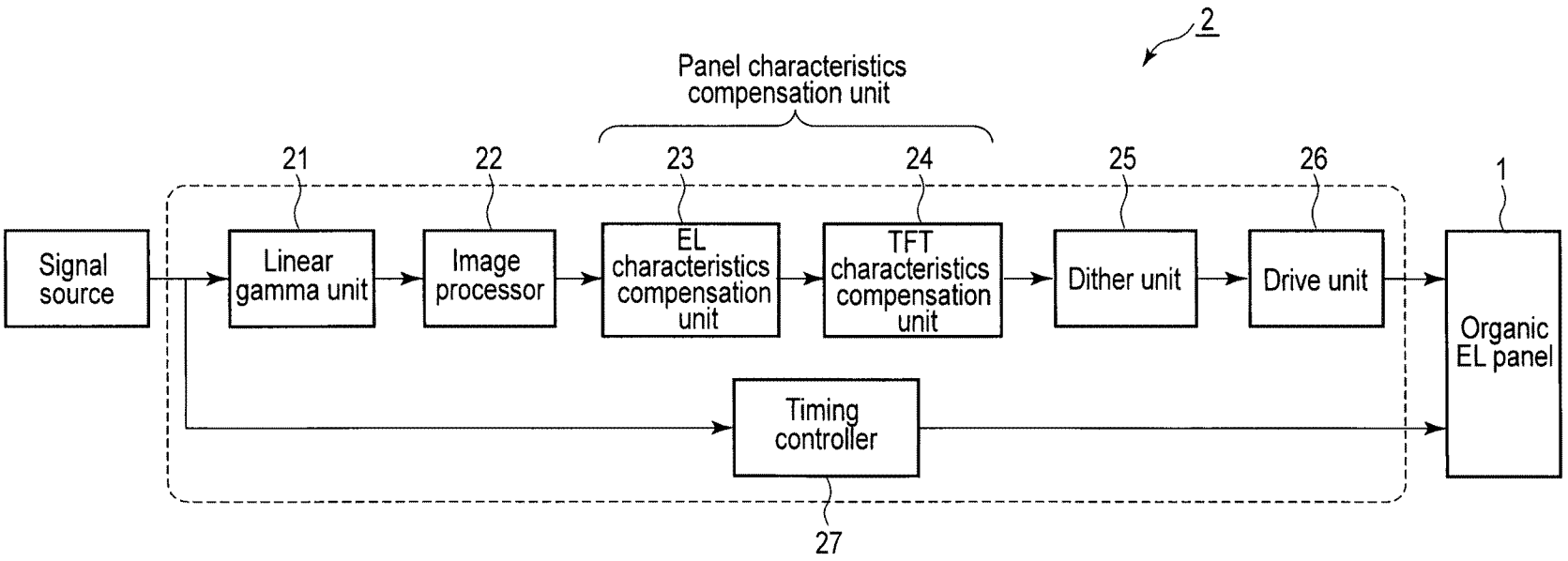
FIG. 3 is an exemplary block diagram showing the structure of a controller of the display device and connection of a signal according to the embodiment.

FIG. 3 is an exemplary block diagram showing the structure of a controller of the display device and connection of a signal according to the embodiment. The controller 2 comprises a linear gamma unit 21, an image processor 22, an EL characteristics compensation unit 23, a TFT characteristics compensation unit 24, a dither unit 25, a drive unit 26 and a timing controller 27.

The linear gamma unit 21 is configured to convert gamma characteristics of the video signal input from the external signal source into linear characteristics. The image processor 22 is configured to subject the video signal to color management processing such as white balance processing and color temperature processing. The EL characteristics compensation unit 23 is configured to correct luminance-current characteristics of the EL element. The TFT characteristics compensation unit 24 is configured to correct voltage-current characteristics of the drive transistor DRT. Here, the EL characteristics compensation unit 23 and the TFT characteristic compensation unit 24 are the main elements of a panel characteristics compensation unit to correct the panel characteristics. The dither unit 25 is configured to process a pseudo-gradation display. The drive unit 26 is configured to output the video signal to the organic EL panel 1 (signal line driving circuit 5). The timing controller 27 is configured to output various timing signals generated from synchronization signals of the external signal source to the organic EL panel 1 (the scanning line driving circuit 4, the signal line driving circuit 5, etc.).

Figure 4A:
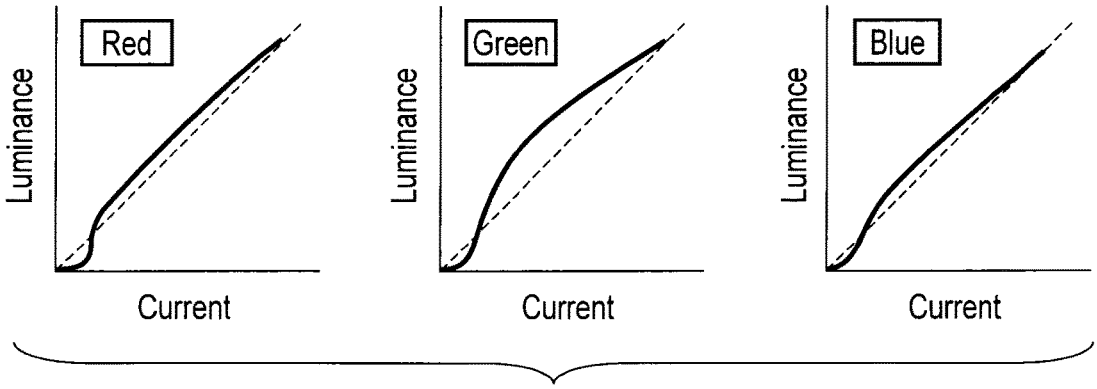
FIG. 4A is an exemplary diagram showing the panel characteristics of the display device according to the embodiment.
Figure 4B:
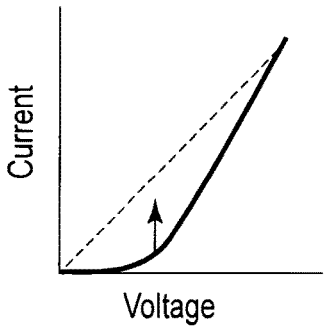
FIG. 4B is another exemplary diagram showing the panel characteristics of the display device according to the embodiment.

FIG. 4A and FIG. 4B are exemplary diagrams showing the panel characteristics of the display device of the embodiment.

FIG. 4A shows the emission characteristics, or more specifically, luminance-current characteristics of the EL element. Note that the emission amount of the EL element is defined by the value of the current flowing thereto, but the luminance-current characteristics are not linear as shown in FIG. 4A. Further, the characteristic curves differ from one another by each color (RGB). Therefore, it is desirable to perform correction of EL characteristics independently for each color of red (R) green (G) and blue (B).

FIG. 4B shows drive characteristics, that is, voltage-current characteristics of the drive transistor DRT. Since the transistor characteristics are nonlinear, the voltage-current characteristics are also not linear as shown in FIG. 4B. However, if the same pixel circuit is used for each of red (R), green (G) and blue (B) pixels, the characteristics of the drive transistors DRT of these pixels become the same; therefore the TFT characteristics are corrected by using the characteristic curve common to RGB.

Next, the digital gradation correction by a multipoint linear approximation, which was studied in advance during research of the display device according to the embodiment, will now be described.

Figure 5:
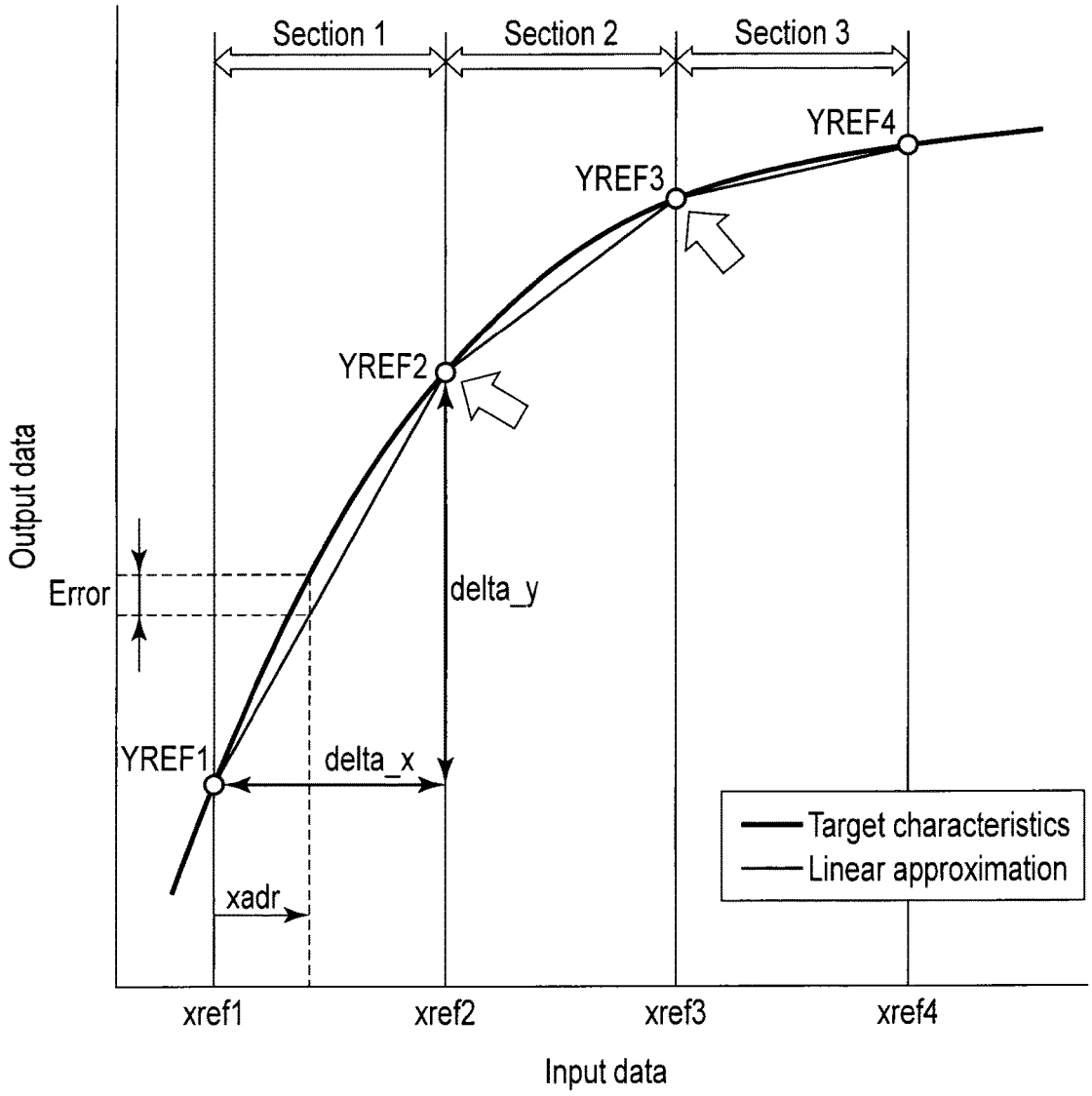
FIG. 5 is an exemplary diagram showing a correction method by a multipoint linear approximation studied in advance of research of the display device according to the embodiment.

FIG. 5 is an exemplary diagram showing a correction method by the multipoint linear approximation studied in advance during research of the display device according to the embodiment. In the prior method, two or more discrete points on the characteristic curve for correction are selected and the intermediate value between the adjacent points (section) is calculated by linear approximation. That is, when the coordinates of two adjacent points are set to (xref1, YREF1), and (xref2, YREF2), the approximate value YAPPX in Y coordinates at the position of (xref1+xadr) in X coordinates is calculated by Formula (1):

$$YAPPX=YREF1+(YREF2-YREF1)/delta_x*xadr$$
$$delta_x=xref2-xref1 \qquad \text{[Formula (1)]}$$

Figure 6:
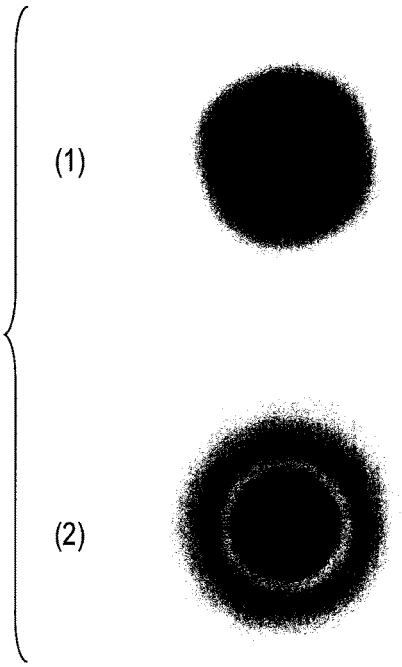
FIG. 6 is an exemplary view showing a gradation display by the multipoint linear approximation studied in advance during research of the display device according to the embodiment.

FIG. 6 is an exemplary view showing a gradation display by the multipoint linear approximation studied in advance of research of the display device according to the embodiment. FIG. 6 shows in (1), an example of the gradation display in target characteristics (true characteristics), and FIG. 6 shows in (2) an example of the gradation display obtained by the multipoint linear approximation system.

In the correction by multipoint linear approximation, the inclination of the approximation straight line changes discontinuously on a boundary between adjacent regions shown in FIG. 5. For this reason, as shown in (2) of FIG. 6, gradation bandings are sometimes observed in a gradation display. Further, when the curvature of the target characteristic curve is large, or when the number of sections for linear approximation is a few, the difference (error) between the true value YVALU and the approximate value YAPPX becomes large.

Figure 7:
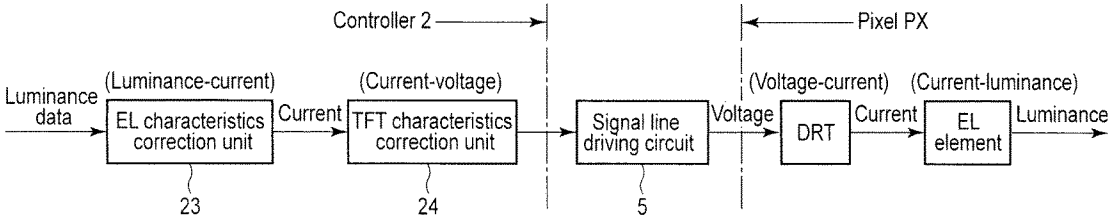
FIG. 7 is an exemplary block diagram showing the configuration of correction of the panel characteristics of the display device according to the embodiment.

FIG. 7 is an exemplary block diagram showing the configuration of correction of the panel characteristics of the display device according to the embodiment. The controller 2 is configured to perform two separated characteristics correction functions, that is, correction of the luminance-current characteristics of the EL element by the EL characteristics correction unit 23 first and thereafter correction of the voltage-current characteristics of the drive transistor DRT by the TFT characteristics correction unit 24. As shown in FIG. 7, when the order of conversions of the physical quantities (luminance, current, voltage), objects to be converted, is specified, it can be understood that the order of the conversions performed by the controller 2 and the order of the conversions performed in the pixels PX are symmetrically related. Here, the order of the conversions in the controller 2 is reversed to that of processor steps in the organic EL panel 1. By setting the order of the characteristic correction circuits in this way, it becomes possible to handle the EL correction and TFT correction separately and independently of each other.

Since the EL characteristics differ from one color to another, the EL characteristics correction unit 23 is configured to correct characteristics which differ from one color to another. On the other hand, since the characteristics of the TFT characteristics correction unit 24 are considered to be the same within the organic EL panel 1 which employs the same pixel circuits, the TFT characteristics correction unit 24 is configured to correct the same characteristics within the organic EL panel 1.

Figure 8:
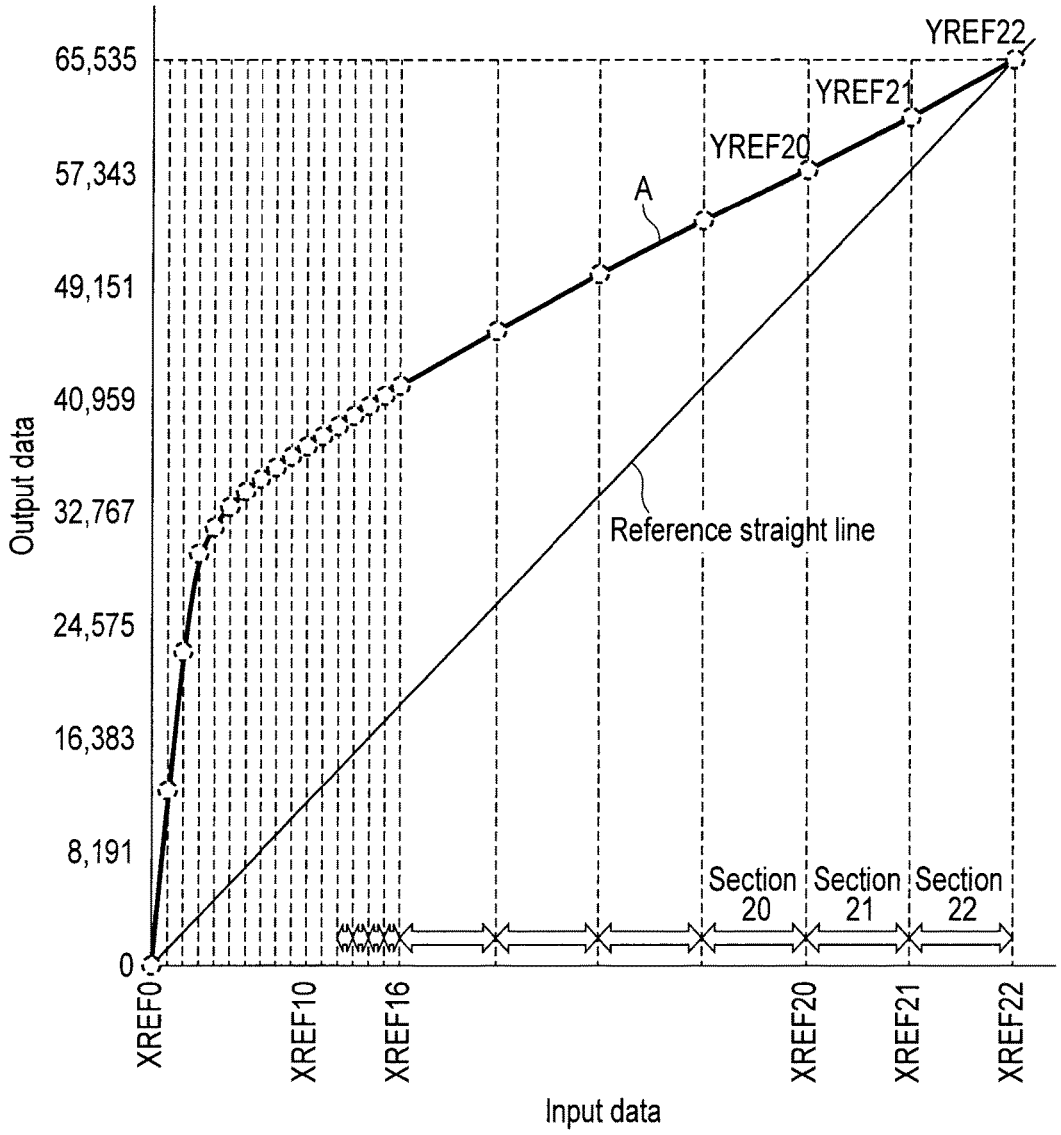
FIG. 8 is an exemplary diagram showing a TFT characteristics correction method of the display device according to the embodiment.

FIG. 8 is an exemplary diagram showing the TFT characteristic correction method of the display device of the embodiment. FIG. 8 shows a correction curve A obtained by converting the TFT characteristic curve shown in FIG. 4B so as to be symmetrical to a reference straight line. That is, FIG. 8 shows the curve expressing the inverse characteristics of the TFT characteristics shown in FIG. 4B. The signal thus input is converted by the inverse characteristics of the TFT characteristics. Here, the reference straight line is provided so that an input value and an output value may have a linear relationship. Therefore, when input data (current) is converted to output data (voltage) according to the correction curve A, the current made to flow by the drive transistor DRT becomes a value according to the reference straight line, that is, the value is not influenced by the TFT characteristics.

In the method shown in FIG. 8, the regions are variable according to the form of the characteristic curve A. The inclination or curvature of the characteristic curve A is large between XREF0 and XREF16 in X coordinates, whereas the inclination and curvature of the characteristic curve A are small between XREF17 and XREF22. Therefore, when the interval of each region between XREF0 and XREF16 is narrowed to be able to correct the characteristics at short intervals in the section where the inclination or curvature of the characteristic curve A is large, an approximate value with less error can be obtained.

Figure 9:
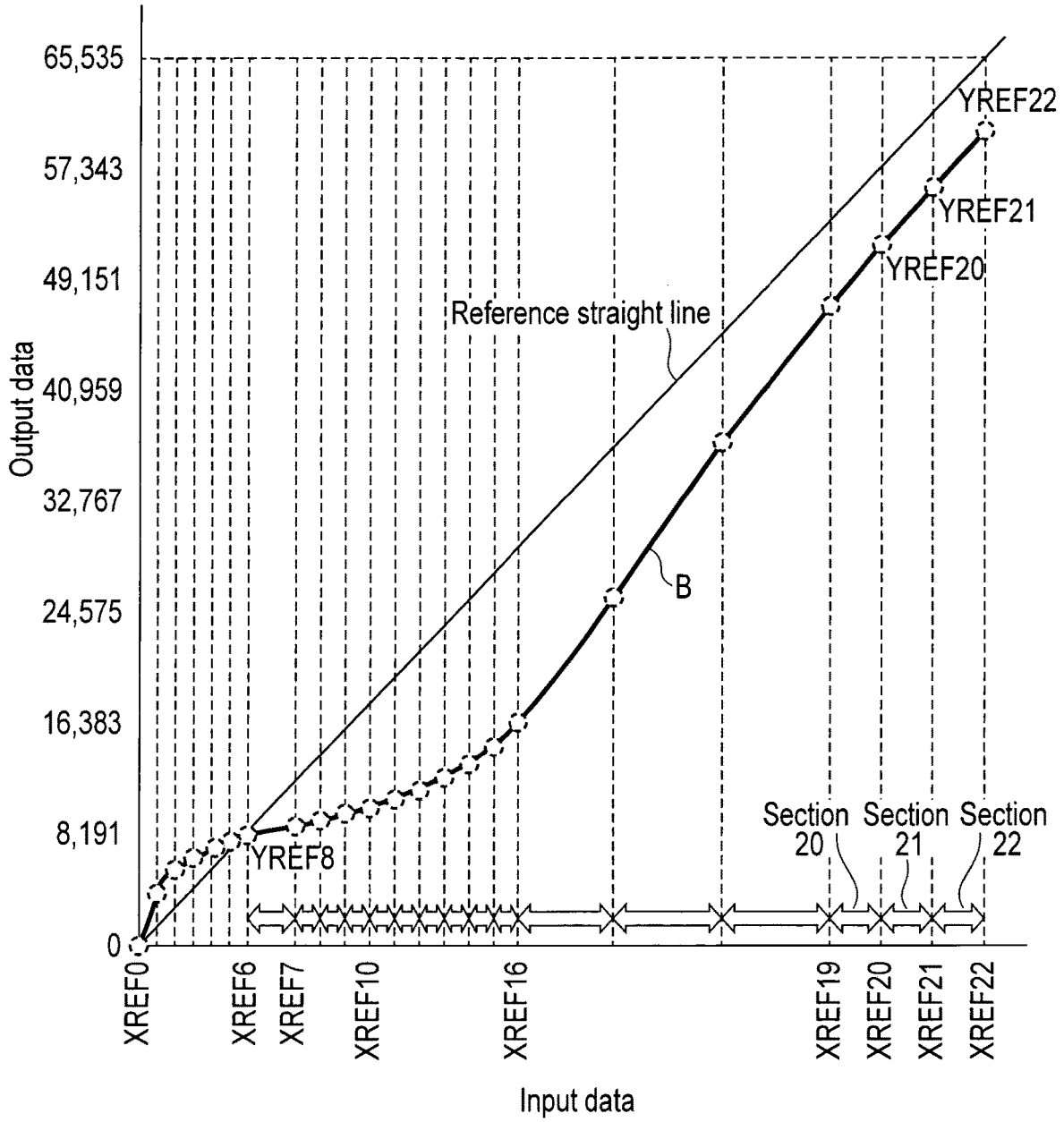
FIG. 9 is a diagram showing the TFT characteristics correction method of the display device according to the embodiment.

FIG. 9 is an exemplary diagram showing the EL characteristics correction method of the display device of the embodiment. FIG. 9 shows a characteristic curve B obtained by converting the EL characteristic curve shown in FIG. 4A so as to be symmetrical to a reference straight line. That is, FIG. 9 shows the curve expressing the inverse characteristics of the EL characteristics shown in FIG. 4A. The signal thus input is converted by the inverse characteristics of the EL characteristics. In FIG. 9, the graph is zoned into five sections in terms of width (XREF0 to XREF6, XREF6 to XREF7, XREF7 to XREF16, XREF16 to XREF19 and XREF19 to XREF22) according to the inclination of the characteristic curve B and the curvature.

For such a structure which can set the width of each section as an arbitrary value, a divider is needed for computing the intermediate point of each section, which is considered to increase the circuit size required for correction and also increase the correction processing load. Here, the increase in the circuit size and processing load is suppressed by defining the method of setting the width of a section. A section width is expressed by delta_x of formula (1), for example, by multipoint linear approximation. Then, when the section width is set up as $2^n$ times (or $1/2^n$ times) (n is an integer of 1 or higher) of a reference value, multiplication and division can be realized by bit shift operation. In this manner, the increase in circuit size for approximating the intermediate point in each section and the increase in processing load can be suppressed.

Note that when the material of the EL element used for the organic EL panel 1 is replaced by another, or when the design of the TFT is changed, the section width may be set automatically or manually according to the inclination and curvature of the characteristic curve, thus varied.

Figure 10:
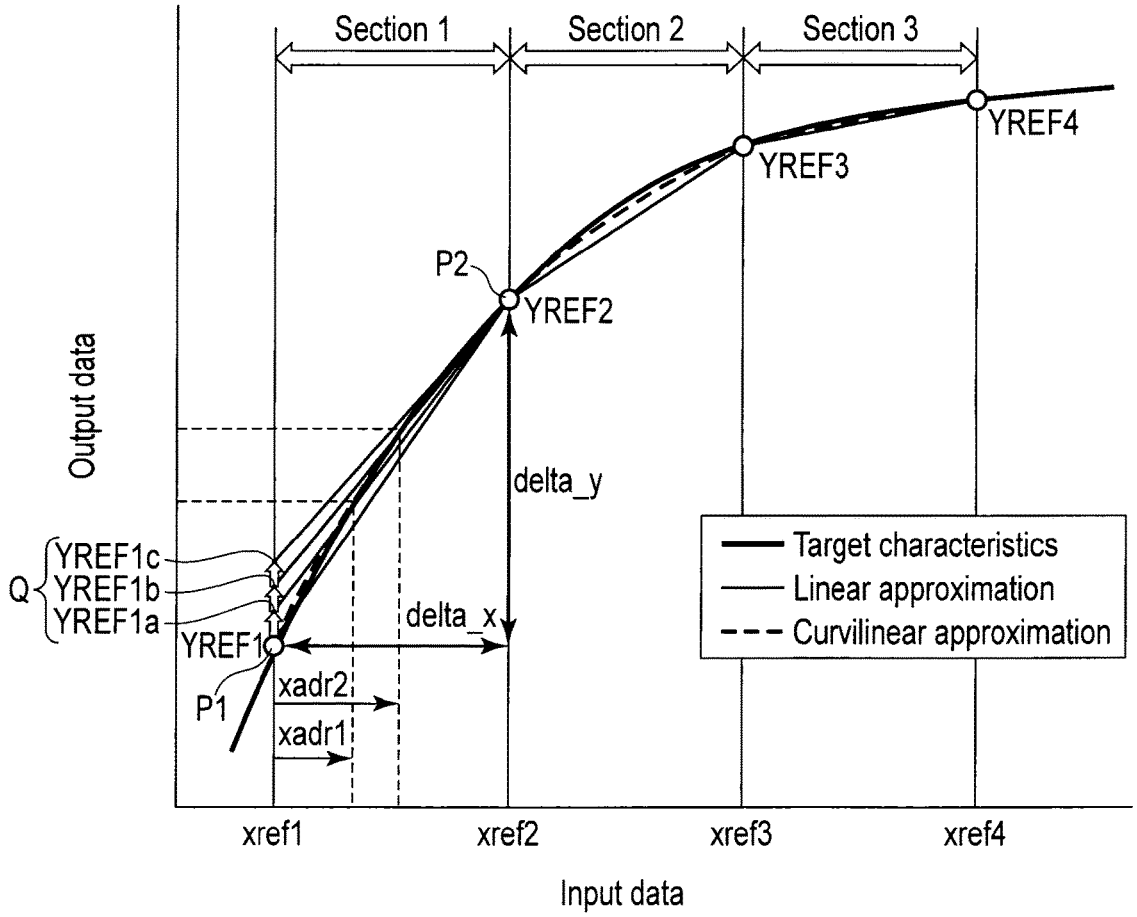
FIG. 10 is a diagram showing another TFT characteristics correction method of the display device according to the embodiment.

FIG. 10 is an exemplary diagram showing another characteristics correction method of the display device of the embodiment. The characteristics correction method shown in FIG. 10 employs a new curvilinear approximation system.

The coordinates of two boundary points P1 and P2 of the section 1 are set as P1 (xref1, YREF1) and P2 (xref2, YREF2). Next, with respect to the boundary point P1, point P1*a* (xref1, YREF1a) whose X coordinate is the same as that of the boundary point P1, that is, xref1, and whose Y coordinate is YREF1a, is set. Then, output data is obtained using the straight line which connects the point P1*a* and the point P2 with respect to input data (xref1+xadr1). On the other hand, with respect to the boundary point P1, point P1*b* (xref1, YREF1b) whose X coordinate is the same as that of the boundary point P1, that is, xref1, and whose Y coordinate is YREF1b, is set. Then, output data is obtained using the straight line which connects the point P1*b* and the point P2 with respect to input data (xref1+xadr2). Similarly, further output data are obtained using new straight lines corresponding to increments in input data.

The above-described method can be defined as a correction method of approximating a correction curve expressed in an XY coordinate system with input data by X axis of coordinates and output data by Y axis of coordinates, wherein the X axis of coordinates is divided into sections, and boundary points are set on the correction curve. In this method, a correction curve segment between the adjacent boundary points P1 and P2 is approximated in the following manner. That is, when input data increments by xadr from the value xref1 of X coordinates at the boundary point P1 of a section, accordingly, the value of Y coordinates at the boundary point P1 is incremented by a multiple factor of the proportionality coefficient of xadr to obtain the new boundary point Q. Then, the output data is obtained using the straight line which connects the point P2 and the point Q as the correction curve.

This method can be represented by using mathematical expressions, and when the coordinates of two adjacent points are (xref1, YREF1) and (xref2, YREF2), the approximate value YAPPX of Y coordinates at the location (xref1+xadr) in X coordinates can be calculated by the following Formula (2).

$$YAPPX=(YREF1+xadr*\alpha)+(YREF2-(YREF1+xadr*\alpha))/delta_x*xadr\ delta_x=xref2-xref1 \quad \text{[Formula (2)]}$$

Note that α is a proportionality coefficient (larger than 0) corresponding to the increment in xadr.

Here, when the right-hand side of Formula (2) is arranged for xadr, Formula (3) can be obtained.

$$YAPPX=-\alpha*(xadr)^2/delta_x+((YREF2-YREF1)/delta_x+\alpha)*xadr+YREF1 \quad \text{[Formula (3)]}$$

That is, since the approximate value YAPPX can be expressed as a quadratic function of xadr, this correction method can be grasped as approximation by a quadratic curve. Further, the coefficient squared of xadr of Formula (3) is −α/delta_x. Therefore, the curvature of the correction curve becomes larger (smaller) as α is larger (or smaller). Thus, the accuracy of approximation to a target correction curve can be adjusted by selecting a value for α.

Figure 11:
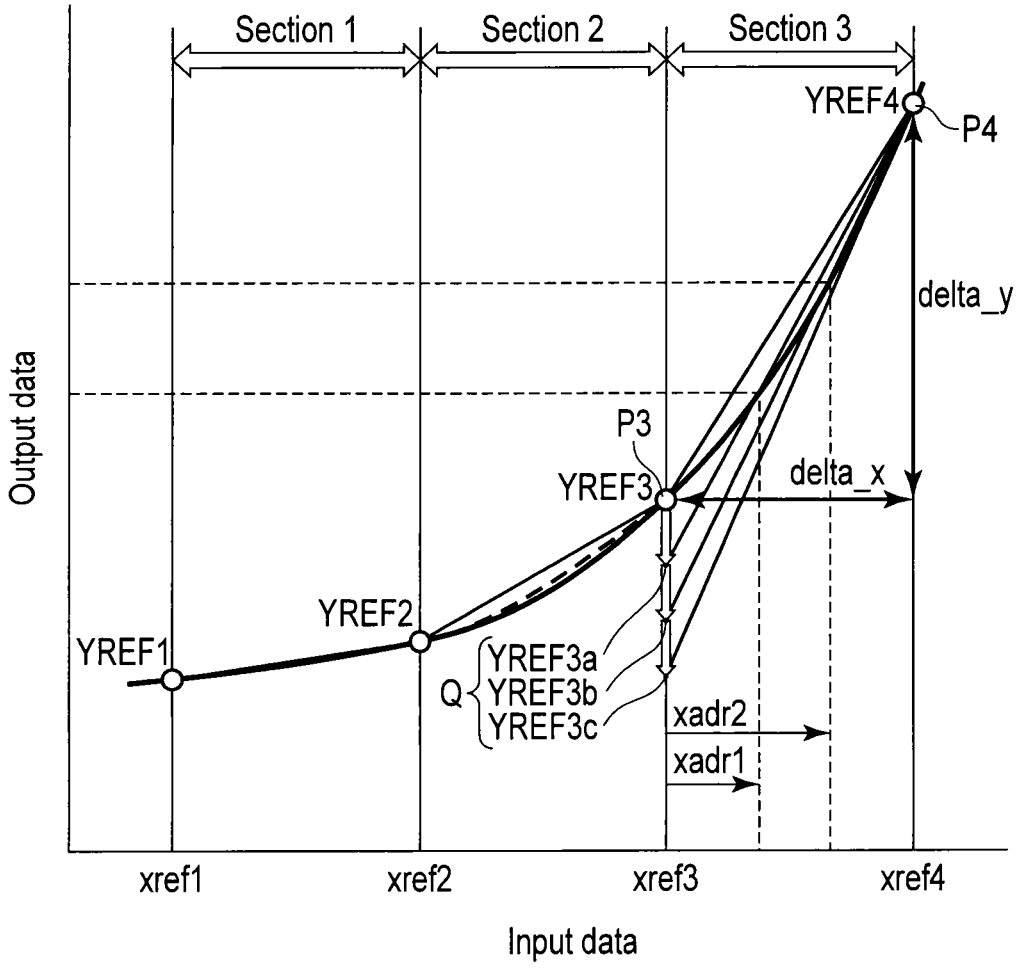
FIG. 11 is a diagram showing still another TFT characteristics correction method of the display device according to the embodiment.

FIG. 11 is an exemplary diagram showing another characteristics correction method of the display device of the embodiment. The curve shown in FIG. 10 has a convex form upward. The curve shown in FIG. 11 has a convex form downward.

The coordinates of two boundary points P3 and P4 of section 3 are set as P3 (xref3, YREF3) and P4 (xref4, YREF4). Next, with respect to the boundary point P3, point P3*a* (xref3, YREF3a) whose X coordinate is the same as that of the boundary point P3, that is, xref3, and whose Y coordinate is YREF3a, is established set. Then, output data is obtained using the straight line which connects the point P3*a* and the point P4 with respect to input data (xref3+xadr1). With respect to the boundary point P3, point P3*b* (xref3, YREF3b) whose X coordinate is the same as that of the boundary point P3, that is, xref3, and whose Y coordinate is YREF3b, is established set. Then, output data is obtained using the straight line which connects the point P3*b* and the point P4 with respect to input data (xref3+xadr3). Similarly, further output data is obtained using a new straight line corresponding to the increment in input data.

The above-described method can be defined as a correction method of approximating a correction curve expressed in an XY coordinate system with input data by X axis of coordinates and output data by Y axis of coordinates, wherein the X axis of coordinates is divided into sections, and boundary points are set on the correction curve. In this method, a correction curve segment between the adjacent boundary points P3 and P4 is approximated in the following manner. That is, when input data increments by xadr from the value xref3 of X coordinates at the boundary point P3 of a section, accordingly, the value of Y coordinates at the boundary point P3 is incremented by a multiple factor of the proportionality coefficient of xadr to obtain the new boundary point Q. Then, the output data is obtained using the straight line which connects the point Q and the point P4 as the correction curve.

This method can be represented by using mathematical expressions, and when the coordinates of two adjacent points are (xref3, YREF3) and (xref4, YREF4), the approximate value YAPPX of Y coordinates at the location (xref3+xadr) in X coordinates can be calculated by the following Formula (4).

$$YAPPX=(YREF3-xadr*\alpha)+(YREF4-(YREF3-xadr*\alpha))/delta_x*xadr\ delta_x=xref4-xref3 \quad \text{[Formula (4)]}$$

Note that α is a proportionality coefficient (larger than 0) corresponding to the increment in xadr.

Here, when the right-hand side of Formula (4) is arranged for xadr, Formula (5) can be obtained.

$$YAPPX=\alpha*(xadr)^2/delta_x+((YREF4-YREF3)/delta_x-\alpha)*xadr+YREF3 \quad \text{[Formula (5)]}$$

That is, since the approximate value YAPPX can be expressed as a quadratic function of xadr, this correction method can be grasped as approximation by a quadratic curve. Further, the coefficient of xadr squared of Formula (5) is α/delta_x. Therefore, the curvature of the correction curve becomes larger (smaller) as α is larger (or smaller). Thus, the accuracy of approximation to a target correction curve can be adjusted by selecting a value for α.

In addition, selection of a shown in FIGS. 10 and 11 can be performed by the following procedure.

(1) Create a graph showing the relationship between the input data and output data of a target correction curve.

(2) Set two or more sections from the inclination and curvature of the target correction curve.

(3) Obtain a polynomial approximated to the target correction curve for each of the set sections.

(4) Set the curvature for each section from the polynomial obtained.

Here, the above-described procedure may be performed manually, automatically using a predetermined program, or an appropriate combination of manual processing and automatic processing.

However, if $\alpha$ is set to an arbitrary value and further the number of coefficient such as $\alpha$ is increased, it is considered that the circuit size required for correction and the load in the correction processing are increased. Here, it is possible to suppress the increase in the circuit size and processing load by specifying the value of $\alpha$. That is, when the value of $\alpha$ is set $2^n$ times (or $1/2^n$ times) (n is an integer of 1 or larger) a reference value, multiplication and division can be realized by bit shift operation. In this manner, the increase in circuit size and the increase in processing load, which may occur in calculating the value of $\alpha$, can be suppressed.

With the correction system according to this embodiment described above, the EL correction and TFT correction can be handled independently. As referring to the EL characteristics and the TFT characteristics shown in FIG. 4A and FIG. 4B, it can be understood that the amount of correction for the EL characteristics is less than that for the TFT characteristics. Therefore, the panel characteristics correction function in the controller 2 shown in FIG. 3 can be configured to comprise two or more modes as indicated below according to the characteristics required for the organic EL panel 1.

(1) Providing the EL characteristics correction unit 23 and the TFT characteristics correction unit 24 in the controller 2 to execute curvilinear approximation corrections shown in FIGS. 10 and 11, respectively.

(2) Providing the EL characteristics correction unit 23 and the TFT characteristics correction unit 24 in the controller 2 so that the EL characteristics correction unit 23 executes the linear approximation correction shown in FIG. 5, and the TFT characteristics correction unit 24 executes the curvilinear approximation correction shown in FIGS. 10 and 11.

(3) Providing only the TFT characteristics correction unit 24 in the controller 2 without the EL characteristics correction unit 23 so that the TFT characteristics correction unit 24 executes the curvilinear approximation correction shown in FIGS. 10 and 11.

In addition, the technical concepts disclosed in the above-provided embodiment is not limited to the display device using the EL element which emits light in colors of RGB, but are applicable also to a display device in which the EL element which emits white light, and an RGB filter are combined. Moreover, the EL element is not limited to an organic electroluminescent element, but an inorganic EL element can be applied as well.

Based on the display device which has been described in the above-described embodiments, a person having ordinary skill in the art may achieve a display device with an arbitral design change; however, as long as they fall within the scope and spirit of the present invention, such a display device is encompassed by the scope of the present invention.

A skilled person would conceive various changes and modifications of the present invention within the scope of the technical concept of the invention, and naturally, such changes and modifications are encompassed by the scope of the present invention. For example, if a skilled person adds/deletes/alters a structural element or design to/from/in the above-described embodiments, or adds/deletes/alters a step or a condition to/from/in the above-described embodiment, as long as they fall within the scope and spirit of the present invention, such addition, deletion, and altercation are encompassed by the scope of the present invention.

Furthermore, regarding the present embodiments, any advantage and effect those will be obvious from the description of the specification or arbitrarily conceived by a skilled person are naturally considered achievable by the present invention.

Various inventions can be achieved by any suitable combination of a plurality of structural elements disclosed in the embodiments. For example, the some structural elements may be deleted from the whole structural elements indicated in the above-described embodiments. Furthermore, some structural elements of one embodiment may be combined with other structural elements of another embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a plurality of pixels arranged in a matrix on a substrate, each comprising a luminescent element and a drive transistor configured to supply current to the luminescent element for light emission; and a controller configured to correct a video signal supplied from outside to be supplied to the pixels for display, wherein the controller executes:

an EL characteristics correction step of correcting the video signal with inverse luminescent characteristics of the luminescent element; and a TFT characteristics correction step of correcting the video signal with inverse drive characteristics of the drive transistor, the controller corrects in the TFT characteristics correction step, the video signal corrected in the EL characteristics correction step with the inverse drive characteristics of the drive transistor, the controller corrects in the TFT characteristics correction step, the video signal by curvilinear approximation using a curve approximated to a correction curve indicating the inverse drive characteristics, the curvilinear approximation is a correction method of approximating a correction curve expressed in an XY coordinate system with input data by X axis of coordinates and output data by Y axis of coordinates, the method comprising, when the X axis of coordinates is divided into sections, boundary points are set on the correction curve, and a correction curve segment between adjacent boundary points P1 and P2 is approximated, obtaining a new boundary point Q in which when input data increments by xadr from a value xref1 of X coordinates at the boundary point P1 of a section, a value of Y coordinates at the boundary point P1 is accordingly incremented by a multiple factor of a proportionality coefficient of xadr, if the correction curve in the section is convex upward, or the value of Y coordinates at the boundary point P1 is accordingly decremented by a multiple factor of the proportionality coefficient of xadr, if the correction curve in the section is convex downward, and obtaining output data using a curve connecting the point P2 and the point Q as the curve approximated to the correction curve, wherein the curve approximated to the correction curve between the boundary points P1 and P2 is represented by a quadratic curve of xadr, and a quadratic coefficient of xadr is smaller than 0 when the correction curve is convex upward and is larger than 0 when the correction curve is convex downward.

2. The display device according to claim 1, wherein the section has a width $2^n$ times or $1/2^n$ times a reference section width.

3. The display device according to claim 1, wherein the proportionality coefficient is $2^n$ times or $1/2^n$ times a reference proportionality coefficient.

4. The display device according to claim 1, wherein the controller corrects in the EL characteristics correction step, the video signal by the curvilinear approximation.

5. The display device according to claim 1, wherein the controller corrects in the EL characteristics correction step, the video signal by linear approximation using a straight line approximated to a correction curve indicating the inverse characteristics, the linear approximation is a correction method of approximating a correction curve expressed in an XY coordinate system with input data by X axis of coordinates and output data by Y axis of coordinates, the method comprising, when the X axis of coordinates is divided into sections, boundary points are set on the correction curve and a correction curve segment between adjacent boundary points P1 and P2 is approximated, obtaining output data using a straight line connecting the point P1 and the point P2 as the correction curve.

6. The display device according to claim 5, wherein the section has a width $2^n$ times or $1/2^n$ times a reference section width.

7. A display device comprising:

a plurality of pixels arranged in a matrix on a substrate, each comprising a luminescent element and a drive transistor configured to supply current to the luminescent element for light emission; and a controller configured to correct a video signal supplied from outside to be supplied to the pixels for display, wherein the controller executes:

an EL characteristics correction step of correcting the video signal with inverse luminescent characteristics of the luminescent element; and a TFT characteristics correction step of correcting the video signal with inverse drive characteristics of the drive transistor, the controller corrects in the TFT characteristics correction step, the video signal corrected in the EL characteristics correction step with the inverse drive characteristics of the drive transistor, the controller corrects in the TFT characteristics correction step, the video signal by curvilinear approximation using a curve approximated to a correction curve indicating the inverse characteristics, the curvilinear approximation is a correction method of approximating a correction curve expressed in an XY coordinate system with input data by X axis of coordinates and output data by Y axis of coordinates, the method comprising, when the X axis of coordinates is divided into sections, boundary points are set on the correction curve, and coordinates of two adjacent points are set as (xref1, YREF1) and (xref2, YREF2), obtaining an approximate value YAPPX of Y coordinates at a location (xref1+xadr) in X coordinates from a following formula:

$$YAPPX=(YREF1+xadr*\alpha)+(YREF2-(YREF1+xadr*\alpha))/delta_x*xadr\ delta_x=xref2-xref1$$

where $\alpha$ is a proportionality coefficient corresponding to the increment in xadr, which is larger than 0 when the correction curve is convex upward but smaller than 0 when the correction curve is convex downward.

8. The display device according to claim 7, wherein the section has a width $2^n$ times or $1/2^n$ times a reference section width.

9. The display device according to claim 7, wherein the proportionality coefficient is $2^n$ times or $1/2^n$ times a reference proportionality coefficient.

10. The display device according to claim 7, wherein the controller corrects in the EL characteristics correction step, the video signal by the curvilinear approximation.

11. The display device according to claim 7, wherein the controller corrects in the EL characteristics correction step, the video signal by curvilinear approximation using a straight line approximated to a correction curve indicating the inverse characteristics, the curvilinear approximation is a correction method of approximating a correction curve expressed in an XY coordinate system with input data by X axis of coordinates and output data by Y axis of coordinates, the method comprising, when the X axis of coordinates is divided into sections, boundary points are set on the correction curve and a correction curve segment between adjacent boundary points P1 and P2 is approximated, obtaining output data using a straight line connecting the point P1 and the point P2 as the correction curve.

12. The display device according to claim 11, wherein the section has a width $2^n$ times or $1/2^n$ times a reference section width.

* * * * *